United States Patent [19]

Horiuchi et al.

[11] 4,452,733

[45] Jun. 5, 1984

[54] EQUIPMENT FOR VOLUME-REDUCING TREATMENT OF RADIOACTIVE WASTE

[75] Inventors: Susumu Horiuchi; Mikio Hirano; Satoshi Hirayama; Ryoichi Ishikawa, all of Hitachi; Hajime Iinuma, Katsuta, all of Japan

[73] Assignee: Hitachi, Ltd., Tokyo, Japan

[21] Appl. No.: 301,100

[22] Filed: Sep. 10, 1981

[30] Foreign Application Priority Data

Sep. 12, 1980 [JP] Japan ..... 55-127808

[51] Int. Cl.[3] ..... G21F 9/08

[52] U.S. Cl. ..... 252/632; 264/0.5; 425/233; 425/406; 425/408; 425/812; 252/626

[58] Field of Search ..... 252/632, 628, 626; 425/233, 406, 408, 812; 264/0.5; 419/38

[56] References Cited

U.S. PATENT DOCUMENTS

| | | | |
|---|---|---|---|
| 3,799,494 | 3/1974 | McLean, Jr. | 425/812 |
| 4,126,291 | 11/1978 | Gilbert et al. | 425/812 |
| 4,140,470 | 2/1979 | Pasch et al. | 425/812 |
| 4,234,448 | 9/1980 | Hirano et al. | 252/626 |
| 4,268,409 | 5/1981 | Ga et al. | 252/632 |
| 4,290,907 | 9/1981 | Horiuchi et al. | 252/632 |
| 4,290,908 | 9/1981 | Horiuchi et al. | 252/632 |

FOREIGN PATENT DOCUMENTS

| | | | |
|---|---|---|---|
| 2430972 | 1/1975 | Fed. Rep. of Germany | 425/406 |
| 103998 | 8/1979 | Japan | 252/632 |
| 621595 | 8/1978 | U.S.S.R. | 425/406 |

*Primary Examiner*—Brooks H. Hunt
*Assistant Examiner*—Howard J. Locker
*Attorney, Agent, or Firm*—Mary Louise Beall

[57] ABSTRACT

An equipment for the volume-reducing treatment of a radioactive waste is disclosed. The equipment comprises means for drying and milling radioactive waste liquor, waste sludge, waste resin and the like generated from an atomic power plant, means for pelletizing the powder obtained from the drying and milling means and means for charging the pellet thus formed into a drum. The pelletizing means is a roller press consisting of a pair of press rolls, each having plural pockets formed on the surface thereof. Air vent grooves are also formed on the surface of each press roll so as to extend from the pocket in the rotating direction of the roll.

15 Claims, 11 Drawing Figures

EQUIPMENT FOR VOLUME-REDUCING TREATMENT OF RADIOACTIVE WASTE

BACKGROUND OF THE INVENTION

This invention relates to an equipment for the volume-reducing treatment of a radioactive waste and more particularly, to an equipment for the volume-reducing treatment of a radioactive waste which dries and mills the radioactive waste and then pelletizes the radioactive powder.

Radioactive wastes generated from an atomic power plant include a concentrated waste liquor formed by subjecting the radioactive waste liquid to the evaporation/concentration treatment, used ion exchange resins from purification equipments for the reactor water and the condensation, and so forth. These wastes are packed in a drum and stored in a site of the plant. However, as the number of operating years of the plant increases, the storage space increases as much. Hence, developments of equipments for the volume-reducing treatment of the radioactive wastes have been made.

Among them, there is an equipment for the volume-reducing treatment developed by the inventors of the present invention (Japanese Patent Laid-Open No. 34200/1977). This equipment first dries and mills the radioactive waste and then press-molds the powder into pellets in order to handle and store the waste as the pellets. This equipment is extremely effective for reducing the volume of the radioactive waste.

However, since the conventional press-molding machines have primarily been developed for use in the fields of pharmaceuticals, foodstuffs, agricultural chemicals, catalysts and the like, their performance is not entirely satisfactory when used for an equipment for the volume-reducing treatment of the radioactive waste.

SUMMARY OF THE INVENTION

The present invention is therefore directed to provide an equipment for the volume-reducing treatment of a radioactive waste which is capable of obtaining pellets having a high volume reduction ratio and high strength at the time of storage and discharge, by improving the conventional press molding machine.

The equipment for the volume-reducing treatment of a radioactive waste to accomplish the abovementioned object of the invention comprises means for drying the radioactive waste, means for milling the radioactive waste thus dried, and a pelletizer for press-molding the radioactive waste thus milled by press rolls, each having plural pockets on the surface thereof and air vent grooves on the surface thereof adjacent the pockets. Namely, the pelletizer used in the present invention is characterized in that plural pelletizing pockets and air vent grooves are formed on the surface of each press roll. Though varying to some extents depending upon the grain diameter of the powder, the air vent grooves each have a width of from several microns to about 1 mm, and the depth and length may be selected over a wide range. Because the air vent groove is disposed for each pocket, deaeration can be sufficiently made from the powder which is compressed by a pair of press rolls and consequently, hard pellets can be produced. Since the strength of each pellet is thus increased, the powder quantity per each pellet can be increased.

Another feature of the present invention resides in that plural pelletizing pockets formed on the press roll surface have at least two groups of varying sizes. According to this arrangement, pellets having varying sizes can be produced and the pellets thus produced can be compactly packed as such into a drum because the pellets of a smaller size fill the gaps between the pellets of a greater size, thereby increasing the packing quantity of pellets per drum, or the quantity of the waste to be packed. The inventors of this invention have found that three kinds, rather than two, of pellets are preferably produced simultaneously, and pelletizing pockets for producing the three kinds of pellets in the same number can be disposed on the press roll.

DESCRIPTION OF THE PREFERRED EMBODIMENTS

Figure 1:
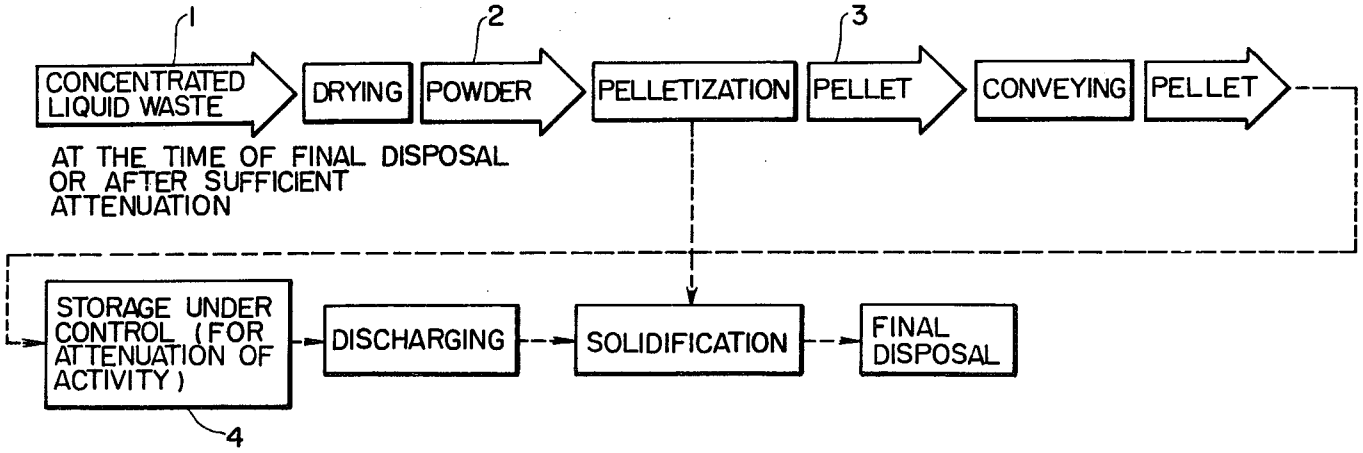
FIG. 1 shows the fundamental process for an equipment for the volume-reducing treatment of a concentrated radioactive waste liquor.

FIG. 1 illustrates the fundamental process for the equipment for the volume-reducing treatment of the concentrated waste liquor as an example of the most ordinary practical application of the present invention. In the drawing, the concentrated waste liquor 1 is first deprived of the water content by evaporation and is then converted into dry powder 2. The powder is pelletized and the resulting pellet is transferred into a tank 4 for storage. As another method of storing the pellet, the pellet may be stored in a container such as a drum besides the tank 4 and these methods may separately be employed, whenever necessary. The pellet thus stored in the tank is withdrawn from the tank when disposal becomes feasible, and is charged and solidifed in a drum by a suitable method.

Figure 2:
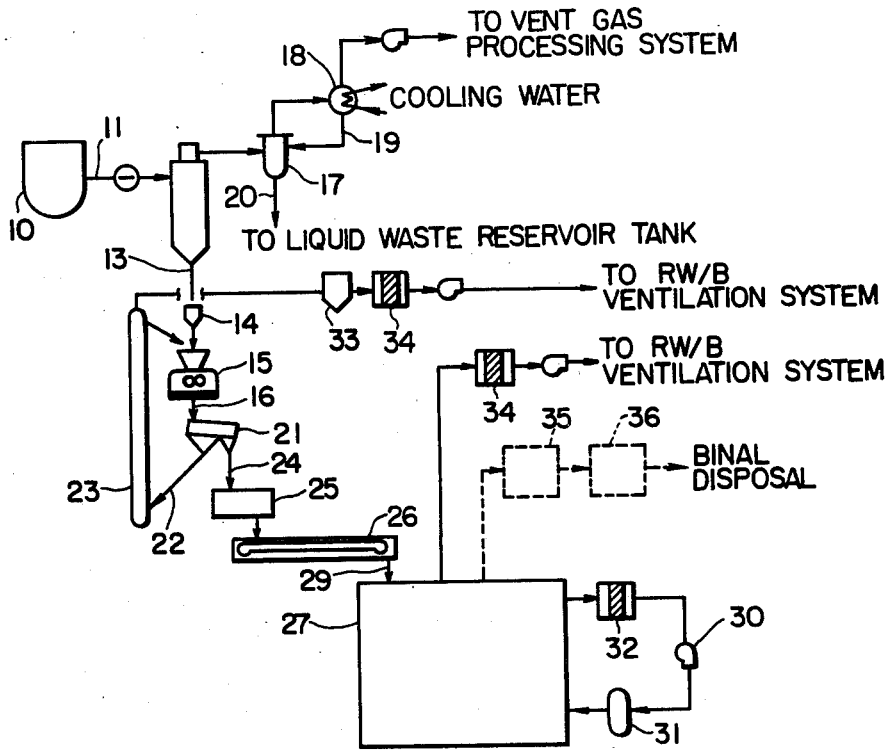
FIG. 2 shows a flow sheet of the equipment for the volume-reducing treatment of the concentrated radioactive waste liquor.

Next, the outline of each process will be described in further detail by referring to the flow sheet shown in FIG. 2.

(1) Drying Process

The concentrated waste liquor 11 placed in a feed tank 10 is dried and milled by a centrifugal membrane dryer 12 and the resulting powder 13 is subjected to the water content check by a neutron water content meter 14. Only powders with a water content below a predetermined level are transferred to a pelletizer 15 whereas the powder having a high water content is dissolved in hot water and is then re-treated. This water content check is indispensable in order to obtain a safe pellet 16 by the pelletizer 15.

On the other hand, the evaporated steam from the centrifugal membrane dryer 12 is condensed by a condensor 18 after decontamination by a mist separator 17. The condensation 19 is used as decontaminating water for the mist separator 17 and is subjected to the concentration treatment as a highly electroconductive waste liquor 20.

(2) Granulation Process

The resulting powder 13 having a water content below the predetermined level is molded into an almond-type pellet 16 by a briquetting type pelletizer 15.

Fins 22 and the like separated from the pellet 16 by a classifier 21 are returned to the pelletizer 15 by a powder recovering device 23 and are pelletized again.

(3) Transportation Process

A belt conveyor system is employed in order to ensure easy maintenance and inspection. The pellets 24 are fed to the conveyor 26 with a substantially constant interval from a constant feeder 25 and are safely transported. A shooter is employed for charging the pellets into a tank 27 to prevent breakage of the pellet 29.

(4) Storage Process

The relative humidity inside the tank 27 must be kept at a low level in order to keep the pellets 29 under the normal state during storage. Hence, the moisture in the air is removed by using a dehumidifier 31 while the air inside the tank 27 is being circulated by a blower 30. A high performance particle filter 32 is disposed in the circulation path.

(5) Others

The inside of the equipment and apparatuses dealing with the powder and pellets are kept at a low negative pressure in order to prevent the powder from scattering outside. A bug filter 33 and a high performance particle filter 34 are disposed in an exhaust line for keeping the low negative pressure.

The pellets inside the pellet storage tank 27 are withdrawn by a withdrawing device 35 when disposal of the pellet becomes feasible, then placed, solidified and sealed in a drum by a solidifying device 36 and to be thereafter disposed.

Figure 3:
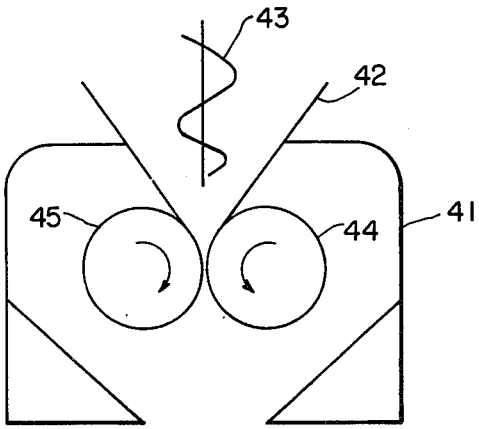
FIG. 3 shows the construction of a pelletizer to be used for the equipment for the volume-reducing treatment of a radioactive waste.

FIG. 3 diagrammatically shows the construction of the briquetting type pelletizer 15 used for the above-mentioned equipment for the volume-reducing treatment. In the drawing, reference numerals 41, 42 and 43 represent a casing of the pelletizer, a hopper and a screw feeder, respectively. Reference numerals 44 and 45 represent press rolls that rotate at a uniform speed in the direction indicated by an arrow. Pockets are defined on the press surfaces of the press rolls 44, 45 for the purpose of molding the pellets. The powder of the waste accepted by the hopper 42 is pushed into the pockets on the press surfaces of the press rolls 44, 45 by its own weight or by the pushing pressure due to the rotation of the screw feeder 43, is then press-molded along with the rotation of the press rolls 44, 45 and is finally discharged from the lower part as the pellets.

FIG. 4 depicts the pockets defined on the press surfaces of the press rolls 44, 45.

Figure 4A:
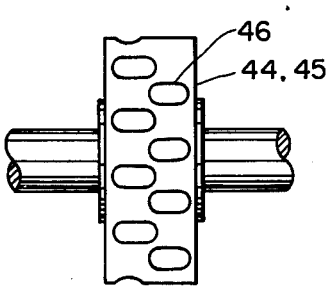
FIG. 4 shows pelletizing pockets of the prior art and those of an embodiment of the present invention.
Figure 4B:
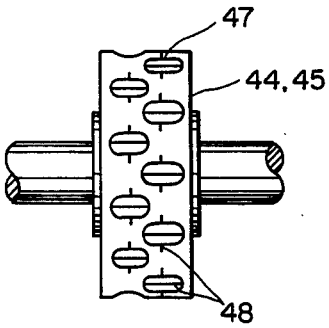

FIG. 4A shows a typical example of the conventional pocket 46 while FIG. 4B shows an example of the pocket 47 used in the present invention. In the case of the conventional pocket 46 shown in FIG. 4A, deaeration is difficult for the powder pushed into the pocket and a pellet having low strength is formed if the air quantity is great in the powder. By contrast, in the pocket 47 shown in FIG. 4B, grooves 48 of several microns are cut on the inner surface of the pocket 47 in the rotating direction of the rolls 44, 45 and also in the direction orthogonal thereto. These grooves 48 serve as the slits on the surface of the rolls 44, 45 and during pelletization, the air inside the powder is exhausted along these grooves 48. Accordingly, lamination does not occur and a granular product having high strength can be formed. The results of actual measurement reveal that the press crush strength of the pellet of the dry powder of the radioactive waste liquor by use of the pelletizer having the pocket 46 shown in FIG. 4A is 50 to 100 $Kg/cm^2$ whereas the press crush strength of the product by use of the pelletizer having the pocket 47 shown in FIG. 4B is as high as 120 to 170 $Kg/cm^2$. Thus, the press crush strength is markedly improved and a pellet having a high strength can be formed.

As another feature of this embodiment, there is an advantage that the density of the pellet can be increased. Namely, if the density increases, the packing quantity of the pellet into the tank 27 increases and hence, the volume-reducing property can be improved as much. According to the actual measurement, the density of the pellet using the pelletizer having the pocket 46 shown in FIG. 4A is 2.4 $g/cm^3$ on an average whereas the density becomes 2.6 $g/cm^3$ on an average when the pelletizer having the pockets 47 shown in FIG. 4B is used. When these two kinds of pellets are packed into a 200 l drum, the packing quantity is about 260 Kg for the former whereas it is about 280 Kg for the latter.

Figure 5:
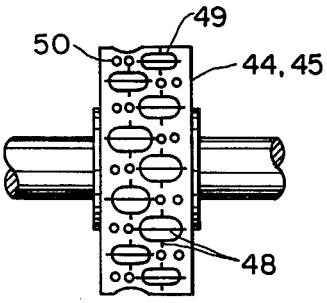
FIG. 5 shows another example of the pelletizing pockets.

This embodiment may be practised in the arrangement shown in FIG. 5 besides the one shown in FIG. 4. Namely, large and small pockets 49 and 50 are defined so that two kinds of pellets can be produced and the packing efficiency into a packing container can be drastically improved. This advantage will be described in the following.

Figure 6B:
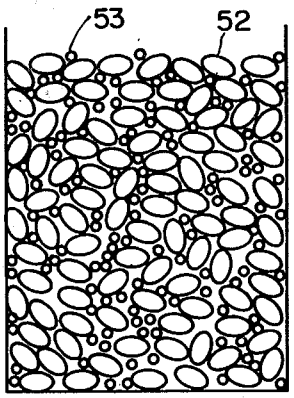
FIG. 6 shows the packing state of the pellets when packed into a drum.
Figure 6A:
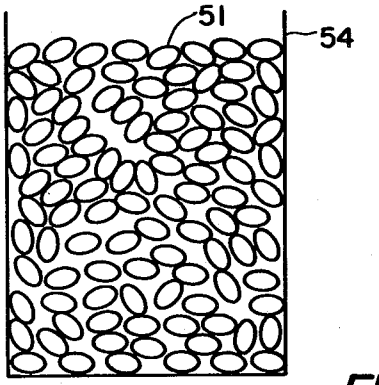

FIG. 6 shows the state when the pellets produced by use of the conventional pelletizer having the same pockets is packed while FIG. 6B shows the state when pellets produced by use of the pelletizer having the pocket arrangement shown in FIG. 5 is packed. In the former, only one kind of pellet, that is, the pellet press-molded by the pockets 46, is packed whereas in the latter, the pellet 53 of a small diameter press-molded by the pocket 50 is shown packed in the gaps between the pellets 52 press-molded by the pocket 49. According to the actual measurement, the void ratio is 40% when the pellet produced by use of the pelletizer having the pocket 46 shown in FIG. 4A is packed into a 200 l drum, and is 20% when the pellet produced by use of the pelletizer having the pockets 49, 50 shown in FIG. 5 is packed into the drum, respectively. In other words, the packing efficiency can be improved to a marked extent. In accordance with the embodiment of the present invention, therefore, about 350 Kg of pellets can be packed into a 200 l drum which is about 1.35 times the packing quantity of the pellets produced by use of the pelletizer having the pocket 46 shown in FIG. 4A.

The second feature of this embodiment resides in that although the number ratio of the pockets 49 and 50 is 1:2 in FIG. 5, the packing efficiency can be adjusted by changing this number ratio of pockets. The packing efficiency can also be controlled by changing the dimensional ratio of the pockets 49 and 50.

A solidifying agent may be charged into the drum into which the pellet is packed, whenever necessary, to carry out the solidification treatment. The solidification density can also be improved if the packing efficiency is improved in accordance with the present invention.

Figure 7:
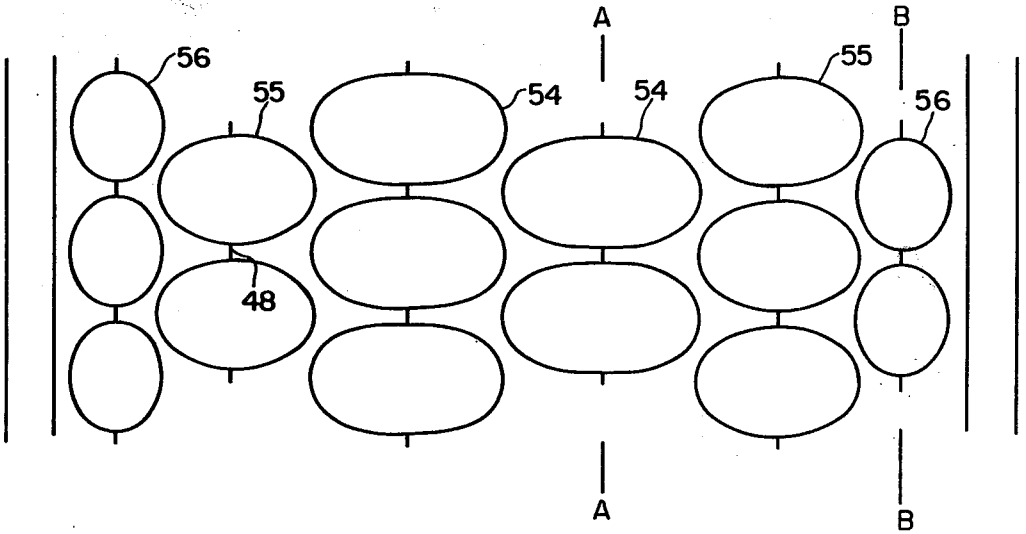
FIGS. 7 through 9 show in detail the pelletizing pockets of a more completed style.
Figure 8B:
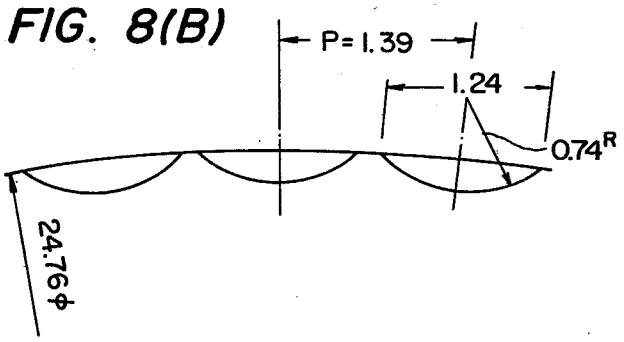
Figure 8A:
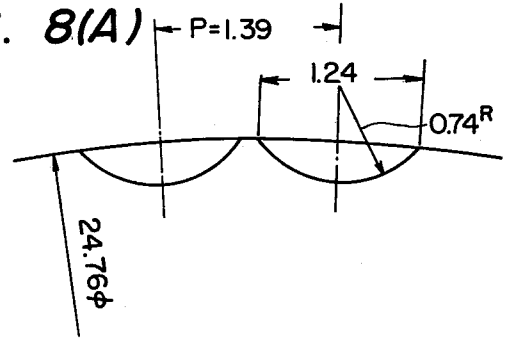
Figure 9:
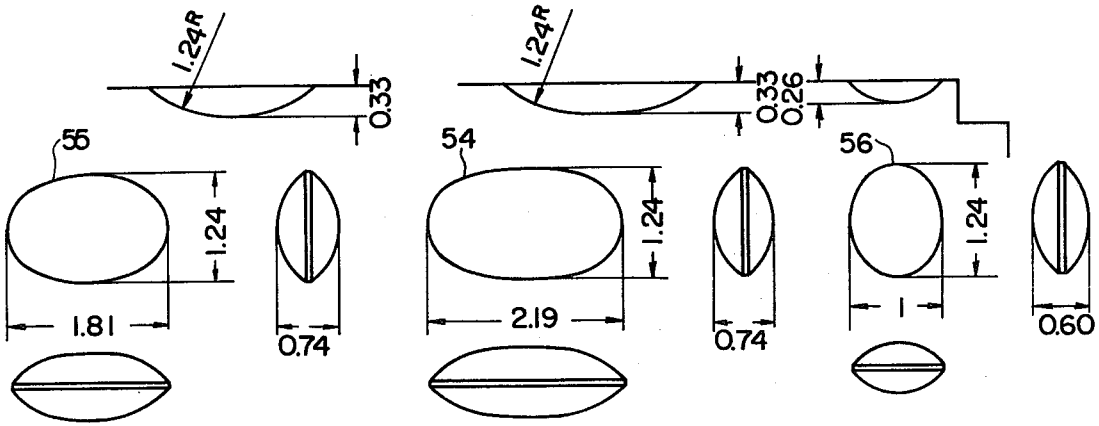

FIGS. 7 through 9 illustrate press rolls having improved pockets. FIG. 7 shows the surface appearance of the press roll, FIG. 8(*l*) is a sectional view taken along line A—A of FIG. 7, FIG. 8(*a*) is a sectional view taken along line B—B of FIG. 7 and FIG. 9 shows the size and shape of each pocket. As can be seen clearly from these drawings, three groups of pockets 54, 55, 56 having varying shapes and sizes are formed on the press roll surface. Dimensions of these pockets 54, 55, 56 are shown in the drawings. The pockets 54, 55, 56 in the same number are formed on each press roll with the same pitch. By forming these pockets 54, 55, 56, it becomes possible to make effective use of the press roll surface and to increase the packing density of the pellets into the tank 27.

Figure 10:
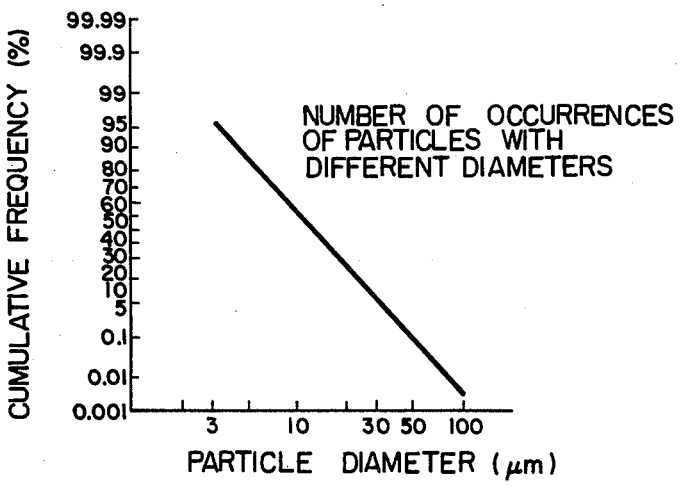
FIG. 10 is a diagram showing the grain diameters of the powder formed by a centrifugal membrane drier.

In order to examine and determine the optimal width of the groove 48, the inventors of the present invention measured the grain diameter of the powder formed by the centrifugal membrane dryer 12 with the results shown in FIG. 10. When a standard concentrated waste liquor is treated, the grain diameter of the resulting powder is 10 μm on an average in terms of article number frequency. Hence, it is obvious that the width of the groove is approximately 10 μm preferably 5–15 μm.

Figure 11:
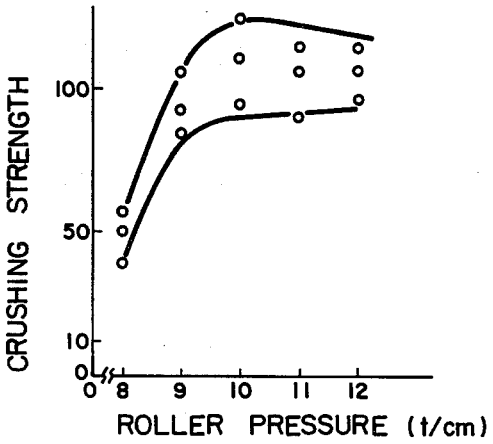
FIG. 11 is a diagram showing the relation between the roll compressive force of the pelletizer and the pellet press crush strength.

Next, FIG. 11 shows the relationship between the roll compressive force of the pelletizer to the powder having a standard composition and pellet press crush strength. As is clear from the drawing, the roll compresive force of about 10 t/cm is suitable and the foregoing embodiment is based upon this roll compressive force 10 t/cm.

What is claimed is:

1. An equipment for the volume-reducing treatment of a radioactive waste, comprising:

means for drying said radioactive waste;

means for milling said radioactive waste thus dried; and a pelletizer for press-molding said radioactive waste thus milled by press rolls, each having plural pockets on the surface thereof and air vent grooves communicating with each of said pockets.

2. The equipment for the volume-reducing treatment of a radioactive waste as defined in claim 1 wherein said drying means and said milling means are a centrifugal membrane dryer.

3. The equipment for the volume-reducing treatment of a radioactive waste as defined in claim 1 or 2 wherein said air vent grooves are formed in the rotating direction of said press rolls.

4. The equipment for the volume-reducing treatment of a radioactive waste as defined in claim 1 or 2 wherein the width of said air vent groove is 5 to 15 μm.

5. The equipment for the volume-reducing treatment of a radioactive waste as defined in claim 3, wherein the width of said air groove is 5 to 15 μm.

6. The equipment for the volume-reducing treatment of a radioactive waste as defined in claim 1, further including means forming a vacuum chamber around said drying means, said milling means and said pelletizer;

a particle filter;

means for evacuating gas from said chamber through said filter to maintain a vacuum within said chamber to prevent escape of radioactive material.

7. An equipment for the volume-reducing treatment of a radioactive waste as defined in claim 1, wherein the pockets in said rolls are arranged in the same pattern and said rolls are interdriven so that respective pockets of the rolls will mate with each other to form an almond-shaped enclosure.

8. The equipment for the volume-reducing treatment of a radioactive waste as defined in claim 1, wherein air vent grooves are formed on the inner surface of said pockets and communicate with said air vent grooves on the surface of said press rolls.

9. The equipment for the volume-reducing treatment of a radioactive waste as defined in claim 18, wherein said air vent grooves are formed in both the rotating direction of said press rolls and in the orthogonal direction thereto.

10. An equipment for the volume-reducing treatment of a radioactive waste, comprising:

means for drying said radioactive waste;

means for milling said radioactive waste thus dried; and a pelletizer for press-molding said radioactive waste thus milled by press rolls, each having at least two groups of pockets having varying sizes arranged on the surface thereof and air vent grooves formed communicating with said pockets.

11. The equipment for the volume-reducing treatment of a radioactive waste as defined in claim 10 wherein said drying means and said milling means are a centrifugal membrane dryer.

12. The equipment for the volume-reducing treatment of a radioactive waste as defined in claim 10, further including means forming a vacuum chamber around said drying means, said milling means and said pelletizer;

a particle filter; and means for evacuating gas from said chamber through said filter to maintain a vacuum within said chamber to prevent escape of radioactive material.

13. The equipment for the volume-reducing treatment of a radioactive waste as defined in claim 10, wherein the pockets in said rolls are arranged in the same pattern and said rolls are interdriven so that respective pockets of the rolls will mate with each other to form an almond-shaped enclosure.

14. The equipment for the volume-reducing treatment of a radioactive waste as defined in claim 10 wherein said pockets comprise three groups of pockets having varying sizes and the length of said pockets in the rotating direction of said press roll is the same.

15. The equipment for the volume-reducing treatment of a radioactive waste as defined in claim 14 wherein said three groups of pockets have progressively decreasing sizes from the center in the direction of width of said press roll.

* * * * *